US008876494B2

(12) United States Patent
Lee et al.

(10) Patent No.: US 8,876,494 B2
(45) Date of Patent: Nov. 4, 2014

(54) COMPRESSOR HAVING FIRST AND SECOND ROTARY MEMBER ARRANGEMENT USING A VANE

(75) Inventors: Kangwook Lee, Changwon-si (KR); Jin-Ung Shin, Changwon-si (KR); Yongchol Kwon, Changwon-si (KR); Geun-Hyoung Lee, Busan (KR)

(73) Assignee: LG Electronics Inc., Seoul (KR)

( * ) Notice: Subject to any disclaimer, the term of this patent is extended or adjusted under 35 U.S.C. 154(b) by 510 days.

(21) Appl. No.: 13/054,963

(22) PCT Filed: Nov. 27, 2008

(86) PCT No.: PCT/KR2008/007007
§ 371 (c)(1),
(2), (4) Date: Jan. 20, 2011

(87) PCT Pub. No.: WO2010/010995
PCT Pub. Date: Jan. 28, 2010

(65) Prior Publication Data

US 2011/0120178 A1 May 26, 2011

(30) Foreign Application Priority Data

| | | |
|---|---|---|
| Jul. 22, 2008 | (KR) | 10-2008-0071381 |
| Nov. 13, 2008 | (KR) | 10-2008-0112748 |
| Nov. 13, 2008 | (KR) | 10-2008-0112751 |
| Nov. 13, 2008 | (KR) | 10-2008-0112752 |

(51) Int. Cl.
*F04B 35/04* (2006.01)

(Continued)

(52) U.S. Cl.
CPC ..... *F04C 23/008* (2013.01); *F04C 18/32* (2013.01); *F04C 29/0085* (2013.01); *F04C 2240/603* (2013.01)
USPC ..... 417/356; 418/64; 418/66

(58) Field of Classification Search
USPC ..... 417/356; 418/13, 63, 64, 66, 67
See application file for complete search history.

(56) References Cited

U.S. PATENT DOCUMENTS

| | | | |
|---|---|---|---|
| 1,526,449 | A | 2/1925 | Wishart |
| 1,947,016 | A | 2/1934 | Mallory |

(Continued)

FOREIGN PATENT DOCUMENTS

| | | |
|---|---|---|
| CN | 1963224 | 5/2007 |
| EP | 1 798 372 A1 | 6/2007 |

(Continued)

OTHER PUBLICATIONS

European Search Report dated Feb. 1, 2012 issued in Application No. 08 87 6616.

(Continued)

*Primary Examiner* — Devon Kramer
*Assistant Examiner* — Nathan Zollinger
(74) *Attorney, Agent, or Firm* — KED & Associates LLP

(57) ABSTRACT

A compressor is provided that includes a stator, a cylinder type rotor rotated within the stator by a rotating electromagnetic field of the stator and that defines a compression chamber inside, a roller that rotates within the compression chamber of the cylinder type rotor by a rotational force transferred from the rotor and compresses a refrigerant during rotation, a vane that divides the compression chamber into a suction region, into which the refrigerant is sucked, and a compression region, in which the refrigerant is compressed and discharged from, and transfers the rotational force from the cylinder type rotor to the roller, an axis of rotation that integrally extends from the roller in an axial direction, and a suction passage, through which the refrigerant is sucked into the compression chamber, through the axis of rotation and the roller.

20 Claims, 9 Drawing Sheets

(51) Int. Cl.

| | |
|---|---|
| ***F04C 18/332*** | (2006.01) |
| ***F04C 18/324*** | (2006.01) |
| ***F04C 29/12*** | (2006.01) |
| ***F04C 23/00*** | (2006.01) |
| ***F04C 18/32*** | (2006.01) |
| *F04C 29/00* | (2006.01) |

(56) References Cited

U.S. PATENT DOCUMENTS

| | | | | |
|---|---|---|---|---|
| 1,998,604 | A | 4/1935 | Belden | |
| 2,246,273 | A | 6/1941 | Ward | |
| 2,246,275 | A * | 6/1941 | Ward | 417/356 |
| 2,246,276 | A | 6/1941 | Ward | |
| 2,309,577 | A | 1/1943 | Ward | |
| 2,324,434 | A * | 7/1943 | Shore | 417/356 |
| 2,331,878 | A | 10/1943 | Wentworth | |
| 2,420,124 | A * | 5/1947 | Chilton | 417/356 |
| 2,440,593 | A | 4/1948 | Miller | |
| 2,898,032 | A * | 8/1959 | Katzenberger | 417/244 |
| 3,070,078 | A | 12/1962 | Horst | |
| 3,499,600 | A | 3/1970 | McGregor | |
| 3,723,024 | A | 3/1973 | Sawai et al. | |
| 4,478,559 | A | 10/1984 | Andrione et al. | |
| 4,629,403 | A | 12/1986 | Wood | |
| 4,710,111 | A | 12/1987 | Kubo | |
| 4,844,703 | A | 7/1989 | Watanabe et al. | |
| 5,522,235 | A | 6/1996 | Matsuoka et al. | |
| 5,547,344 | A | 8/1996 | Sugiyama et al. | |
| 5,564,916 | A | 10/1996 | Yamamoto et al. | |
| 5,577,903 | A | 11/1996 | Yamamoto | |
| 5,580,231 | A | 12/1996 | Yasui | |
| 5,616,019 | A | 4/1997 | Hattori et al. | |
| 6,077,058 | A | 6/2000 | Saitou et al. | |
| 6,213,732 | B1 | 4/2001 | Fujio | |
| 6,478,558 | B2 | 11/2002 | Yamanaka et al. | |
| 6,484,846 | B1 | 11/2002 | Parker | |
| 6,491,063 | B1 | 12/2002 | Benatav | |
| 6,749,405 | B2 | 6/2004 | Bassine | |
| 6,881,041 | B2 | 4/2005 | Lee | |
| 6,929,455 | B2 | 8/2005 | Dreiman et al. | |
| 7,029,252 | B2 | 4/2006 | Masuda et al. | |
| 7,104,764 | B2 | 9/2006 | Lee et al. | |
| 7,217,110 | B2 * | 5/2007 | Dreiman | 418/173 |
| 7,293,966 | B2 | 11/2007 | Cho et al. | |
| 7,344,367 | B2 | 3/2008 | Manole | |
| 7,361,004 | B2 | 4/2008 | Hwang et al. | |
| 7,556,485 | B2 | 7/2009 | Kanayama et al. | |
| 7,704,060 | B2 | 4/2010 | Morimoto et al. | |
| 2004/0071570 | A1 | 4/2004 | Dreiman et al. | |
| 2005/0008519 | A1 | 1/2005 | Masuda et al. | |
| 2005/0031465 | A1 * | 2/2005 | Dreiman et al. | 417/356 |
| 2005/0201884 | A1 | 9/2005 | Dreiman | 418/173 |
| 2006/0159570 | A1 | 7/2006 | Manole | |
| 2012/0171065 | A1 * | 7/2012 | Lee | 418/66 |

FOREIGN PATENT DOCUMENTS

| | | | |
|---|---|---|---|
| FR | 345995 | A | 12/1904 |
| FR | 1367234 | A | 7/1964 |
| GB | 478146 | | 1/1938 |
| JP | 57-186086 | A | 11/1982 |
| JP | 60-187783 | A | 9/1985 |
| JP | 60-206995 | A | 10/1985 |
| JP | 61-187591 | A | 8/1986 |
| JP | 01-232191 | A | 9/1989 |
| JP | 2008-069643 | | 3/2008 |
| KR | 20-0252922 | | 11/2001 |
| KR | 10-2004-0003346 | | 1/2004 |
| KR | 10-2005-0012009 | | 1/2005 |
| KR | 10-2007-0073314 | | 7/2007 |
| WO | WO 2008/004983 | | 1/1998 |
| WO | WO 2007/074637 | | 7/2007 |

OTHER PUBLICATIONS

European Search Report dated Feb. 1, 2012 issued in Application No. 08 87 6617.

European Search Report dated Feb. 1, 2012 issued in Application No. 08 87 6619.

International Search Report issued in PCT Application No. PCT/KR2008/007007 dated Feb. 16, 2010.

Chinese Office Action dated Dec. 4, 2012.

U.S. Office Action issued in Application No. 13/054,981 dated Mar. 26, 2013.

U.S. Office Action issued in Application No. 13/055,026 dated Mar. 25, 2013.

International Search Report issued in PCT Application No. PCT/KR2008/007014 dated Feb. 10, 2010.

International Search Report issued in PCT Application No. PCT/KR2008/007006 dated Feb. 10, 2010.

International Search Report issued in PCT Application No. PCT/KR2008/007008 dated Feb. 16, 2010.

International Search Report issued in PCT Application No. PCT/KR2008/007015 dated Feb. 10, 2010.

International Search Report issued in PCT Application No. PCT/KR2008/007016 dated Feb. 16, 2010.

U.S. Notice of Allowance issued in U.S. Appl. No. 13/055,026 dated Sep. 12, 2013.

U.S. Office Action issued in U.S. Appl. No. 13/055,020 dated Sep. 23, 2013.

U.S. Office Action issued in U.S. Appl. No. 13/055,040 dated Oct. 10, 2013.

U.S. Office Action issued in U.S. Appl. No. 13/055,020 dated Mar. 10, 2014.

U.S. Office Action issued in U.S. Appl. No. 13/054,981 dated Nov. 21, 2013.

U.S. Office Action issued in U.S. Appl. No. 13/054,970 dated Jan. 31, 2014.

Korean Office Action dated Jun. 2, 2014.

U.S. Office Action issued in U.S. Appl. No. 13/054,981 dated Jun. 20, 2014.

Korean Office Action dated Jun. 24, 2014.

U.S. Office Action issued in U.S. Appl. No. 13/055,020 dated Jun. 25, 2014.

Korean Office Action dated Jul. 29, 2014.

* cited by examiner

COMPRESSOR HAVING FIRST AND SECOND ROTARY MEMBER ARRANGEMENT USING A VANE

TECHNICAL FIELD

The present invention relates in general to a compressor, and more particularly, to a compressor having a structure which is suitable for compact design by forming a compression chamber inside a compressor by means of a rotor of electromotive mechanism for driving the compressor, which can maximize the compression efficiency by minimizing frictional loss between rotary elements inside the compressor, and which can minimize a refrigerant leak within the compression chamber.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in electric home appliances such as a refrigerator and an air conditioner, or in the whole industry.

The compressors are roughly classified into a reciprocating compressor wherein a compression chamber to/from which an operation gas is sucked and discharged is defined between a piston and a cylinder and refrigerant is compressed as the piston linearly reciprocates inside the cylinder, a rotary compressor which compresses an operation gas in a compression chamber defined between an eccentrically-rotated roller and a cylinder, and a scroll compressor wherein a compression chamber to/from which an operation gas is sucked and discharged is defined between an orbiting scroll and a fixed scroll and refrigerant is compressed as the orbiting scroll rotates along the fixed scroll.

Although the reciprocating compressor is excellent in mechanical efficiency, its reciprocating motion causes serious vibrations and noise problems. Because of this problem, the rotary compressor has been developed as it has a compact size and demonstrates excellent vibration properties.

The rotary compressor is configured in a manner that a motor and a compression mechanism part are mounted on a drive shaft in a hermetic container, a roller fitted around an eccentric portion of the drive shaft is positioned inside a cylinder that has a cylinder shape compression chamber therein, and at least one vane is extended between the roller and the compression chamber to divide the compression chamber into a suction region and a compression region, with the roller being eccentrically positioned in the compression chamber. In general, vanes are supported by springs in a recess of the cylinder to pressurize surface of the roller, and the vane(s) as noted above divide(s) the compression chamber into a suction region and a compression region. In general, vanes are supported by springs in a recess of the cylinder to pressurize surface of the roller, and the vane(s), as noted above, divide(s) the compression chamber into a suction region and a compression region. The suction region expands gradually with the rotation of the drive shaft to suck refrigerant or a working fluid into it, while the compression region shrinks gradually at the same time to compress refrigerant or a working fluid in it.

In such a conventional rotary compressor, the eccentric portion of the drive shaft continuously makes a sliding contact, during its rotation, with an interior surface of a stationary cylinder where the roller is secured and with the tip of the vane where the roller is also secured. A high relative velocity is created between constituent elements making a sliding contact with each other, and this generates frictional loss, eventually leading to degradation of compressor efficiency. Also, there is still a possibility of a refrigerant leak at the contact surface between the vane and the roller, thereby causing degradation of mechanical reliability.

Unlike the conventional rotary compressors subject to stationary cylinders, U.S. Pat. No. 7,344,367 discloses a rotary compressor having a compression chamber positioned between a rotor and a roller rotatably mounted on a stationary shaft. In this patent, the stationary shaft extends longitudinally inwardly within a housing, and a motor includes a stator and a rotor, with the rotor being rotatably mounted on the stationary shaft within the housing, the roller being rotatably mounted on an eccentric portion that is integrally formed with the stationary shaft. Further, a vane is interposed between the rotor and the roller to let the roller rotate along with the rotation of the roller, such that a working fluid can be compressed within the compression chamber. However, even in this patent, the stationary shaft still makes a sliding contact with an interior surface of the roller so a high relative velocity is created between them and the patent still shares the problems found in the conventional rotary compressor.

Meanwhile, WO2008/004983 discloses another type of rotary compressors, comprising: a cylinder, a rotor mounted in the cylinder to rotate eccentrically with respect to the cylinder, and a vane positioned within a slot which is arranged at the rotor, the vane sliding against the rotor, wherein the vane is connected to the cylinder to transfer a force to the cylinder rotating along with the rotation of the rotor, and wherein a working fluid is compressed within a compression chamber defined between the cylinder and the rotor. However, these rotary compressors require a separate electric motor for driving the rotor because the rotor rotates by a drive force transferred through the drive shaft. That is, when it comes to the rotary compressor in accordance with the disclosure, a separate electric motor is stacked up in the height direction about the compression mechanism part consisting of the rotor, the cylinder and the vane, so the total height of the compressor inevitably increases, thereby making difficult to achieve compact design.

DISCLOSURE OF INVENTION

Technical Problem

The present invention is conceived to solve the aforementioned problems in the prior art. An object of the present invention is to provide a compressor which is suitable for compact design by forming a compression chamber inside a compressor by means of a rotor of electromotive mechanism for driving the compressor, and which can minimize frictional loss by reducing relative velocity between rotary elements inside the compressor.

Another object of the present invention is to provide a compressor having a structure to minimize a refrigerant leak within the compression chamber.

Technical Solution

An aspect of the present invention provides a compressor, comprising: a stator; a cylinder type rotor rotating within the stator by a rotating electromagnetic field from the stator, with the rotor defining a compression chamber inside; a roller rotating within the compression chamber of the cylinder type rotor by a rotational force transferred from the rotor, with the roller compressing refrigerant during rotation; a vane dividing the compression chamber into a suction region where refrigerant is sucked in and a compression region where the refrigerant is compressed/discharged from, with the vane transferring the rotational force from the cylinder type rotor to the roller; an axis of rotation integrally formed with the roller and extending in an axial direction; and a suction passage sucking refrigerant into the compression chamber through the axis of rotation and the roller.

In an exemplary embodiment of the invention, the suction passage comprises a first suction passage being open in an axial direction of the axis of rotation, and a second suction passage for communicating the first suction passage and the compression chamber.

In an exemplary embodiment of the invention, the second suction passage is extended in a radial direction between the center of the axis of rotation and the outer circumferential surface of the roller to be oriented towards the center of the axis of the rotation.

In an exemplary embodiment of the invention, the second suction passage is extended in a radial direction between the center of the axis of rotation and the outer circumferential surface of the roller to be oriented towards the center of the axis of the rotation.

In an exemplary embodiment of the invention, the second suction passage is formed in the outer circumferential surface of the roller in communication with a portion of a suction region contiguous with the vane.

In an exemplary embodiment of the invention, there are two of the second suction passage spaced apart a predetermined distance from each other in the longitudinal direction of the axis of rotation.

In an exemplary embodiment of the invention, the compressor is provided within a hermetic container, with the compressor further comprising: a first cover and a second cover secured to an upper portion and a lower portion of the cylinder type rotor for rotating with the cylinder type rotor as one unit and defining the compression chamber between the cylinder type rotor and the roller, and receiving the axis of rotation therethrough; and a first bearing and a second bearing secured to an interior of the hermetic container for rotatably supporting the first cover and the second cover, with one of the first and second bearings including a suction guide passage communicated with the suction passage to guide a refrigerant suction.

In an exemplary embodiment of the invention, the suction guide passage comprises a first suction guide passage communicated in a radial direction of the bearing, and a second suction guide passage communicated in a shaft direction of the bearing for communicating the first suction guide passage with the suction passage.

In an exemplary embodiment of the invention, the compressor further comprises a suction tube installed within the hermetic container in the axial direction for sucking refrigerant into the hermetic container.

In an exemplary embodiment of the invention, the suction guide passage of the bearing is communicated with the interior space of the hermetic container.

In an exemplary embodiment of the invention, the compressor further comprises a suction tube inserted into the first suction guide passage through the hermetic container for sucking refrigerant into the first suction guide passage.

In an exemplary embodiment of the invention, one of the first and second covers comprises a discharge port communicated with the compression region, and wherein one of the first and second bearings comprises a discharge guide passage communicated with the discharge port in the cover to guide a refrigerant discharge.

In an exemplary embodiment of the invention, the discharge port in the cover is formed in communication with a portion of a compression region contiguous with the vane.

In an exemplary embodiment of the invention, the discharge guide passage of the bearing is formed in an annular or ring shape to circumscribe a revolving orbit of the discharge port in the cover.

In an exemplary embodiment of the invention, the compressor further comprises a discharge tube inserted into the bearing from outside of the hermetic container, with the discharge tube being connected with the discharge guide passage of the bearing.

In an exemplary embodiment of the invention, the discharge guide passage of the bearing guides refrigerant to be discharged into a shell. Also, the compressor further comprises a discharge tube which passes through the hermetic container for discharging a compressed refrigerant filled inside the hermetic container.

Another aspect of the present invention provides a compressor, comprising: a hermetic container including a suction tube and a discharge tube; a stator secured within the hermetic container; a first rotating member rotating, by a rotating electromagnetic field from the stator, about a first axis of rotation which is collinear with a center of the stator and extended in a longitudinal direction, and including a first cover and a second cover secured to an upper portion and a lower portion thereof for rotating together as one unit; a second rotating member rotating within the first rotating member by a rotational force transferred from the first rotating member, with the second rotating member rotating about a second axis of rotation which is extended through the first and second covers and compressing refrigerant in a compression chamber which is defined between the rotating members; a vane dividing the compression chamber into a suction region where refrigerant is sucked in and a compression region where the refrigerant is compressed/discharged from, with the vane transferring the rotational force from the first rotating member to the second rotating member; a bearing secured within the hermetic container for rotatably supporting the first axis of rotation, the second axis of rotation, and the first rotating member; a suction passage for sucking refrigerant into the compressor chamber through the second axis of rotation and the second rotating member; and a discharge port formed in one of the first and second covers, with the discharge port being communicated with the compression region.

In another exemplary embodiment of the invention, the centerline of the second axis of rotation is spaced apart from the centerline of the first axis of rotation.

In another exemplary embodiment of the invention, the longitudinal centerline of the second rotating member is collinear with the centerline of the second axis of rotation.

In another exemplary embodiment of the invention, the longitudinal centerline of the second rotating member is spaced apart from the centerline of the second axis of rotation.

In another exemplary embodiment of the invention, the centerline of the second axis of rotation is collinear with the centerline of the first axis of rotation, and the longitudinal centerline of the second rotating member is spaced apart from the centerline of the first axis of rotation and the centerline of the second axis of rotation.

In another exemplary embodiment of the invention, the suction passage comprises a first suction passage being open in an axial direction of the second axis of rotation, and a second suction passage for communicating the first suction passage and the compression chamber.

In another exemplary embodiment of the invention, the second suction passage is extended in a radial direction between the center of the second axis of rotation and the outer circumferential surface of the second rotating member to be oriented towards the center of the second axis of the rotation.

In another exemplary embodiment of the invention, the suction passage is formed in the outer circumferential surface of the second rotating member in communication with a suction region continuous to the vane.

In another exemplary embodiment of the invention, there are two of the second suction passage spaced apart a predetermined distance from each other in the longitudinal direction of the second axis of rotation.

In another exemplary embodiment of the invention, the bearing includes a suction guide passage communicated with the suction passage to guide a refrigerant suction.

In another exemplary embodiment of the invention, the suction guide passage comprises a first suction guide passage communicated in a radial direction of the bearing, and a second suction guide passage communicated in a shaft direction of the bearing for communicating the first suction guide passage with the suction passage.

In another exemplary embodiment of the invention, the suction guide passage of the bearing communicates with the interior space of the hermetic container.

In another exemplary embodiment of the invention, the suction tube is inserted into the suction guide passage of the bearing.

In another exemplary embodiment of the invention, the bearing comprises a discharge guide passage communicated with a discharge port in the cover to guide a refrigerant discharge.

In another exemplary embodiment of the invention, the discharge port in the cover communicates with a portion of a compression region contiguous with the vane.

In another exemplary embodiment of the invention, the discharge guide passage of the bearing is formed in an annular or ring shape to circumscribe a revolving orbit of the discharge port in the cover.

In another exemplary embodiment of the invention, the discharge guide passage of the bearing communicates with a discharge tube that is inserted into the bearing from outside of the hermetic container.

In another exemplary embodiment of the invention, the discharge guide passage of the bearing communicates with the interior space of the hermetic container.

In another exemplary embodiment of the invention, the discharge tube communicates with the interior space of the hermetic container.

Advantageous Effects

The compressor having the above configuration in accordance with the present invention is advantageous in that it not only enables compact design with a minimal height and reduced size of the compressor by radially arranging the compression mechanism and the electromotive mechanism to define the compression chamber inside the compressor by the rotor of the electromotive mechanism, but it also minimizes frictional loss on account of a substantially reduced relative velocity difference between the cylinder type rotor and the roller by compressing refrigerant in the compression chamber between the rotor and the roller through the rotational force that is transferred to the roller from the rotating rotor, thereby maximizing the compressor efficiency.

Moreover, since the vane defines the compression chamber as it reciprocates between the cylinder type rotor and the roller, without necessarily making a sliding contact with the rotor or the roller, a refrigerant leak within the compression chamber can be minimized with the simple structure, thereby maximizing the compressor efficiency.

In addition, the discharge port formed in the cover that rotates together with the cylinder type rotor and the roller makes possible the continuous suction of refrigerant into the compression chamber even when both the rotor and the roller rotate.

Furthermore, by including the bearing to support the axis of rotation and the refrigerant guide passage to guide refrigerant from the bearing to the axis of rotation, it becomes possible to suck/discharge refrigerant while supporting the axis of rotation through the bearing.

MODE FOR THE INVENTION

Hereinafter, preferred embodiments of the present invention will be described in detail with reference to the accompanying drawings.

Figure 1:
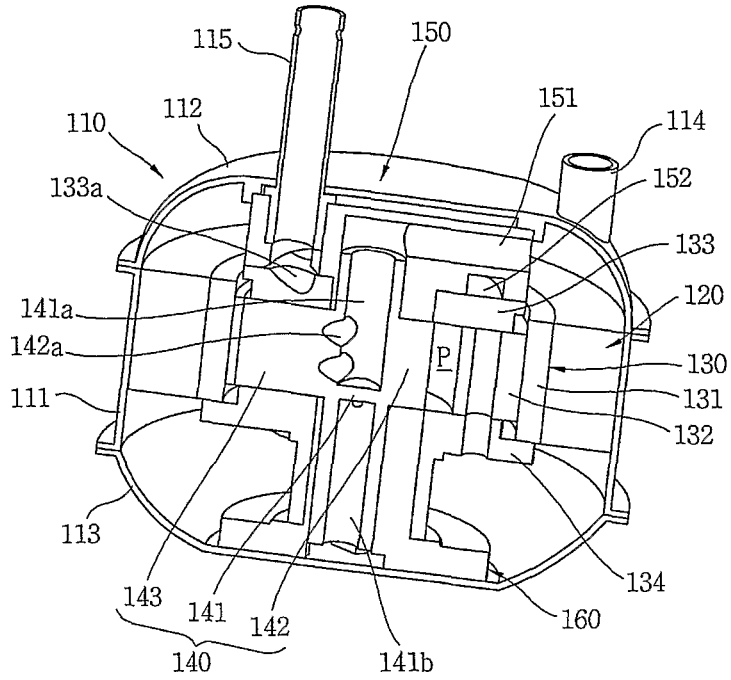
FIG. 1 is a transverse cross-sectional view showing a compressor in accordance with a first embodiment of the present invention.
Figure 2:
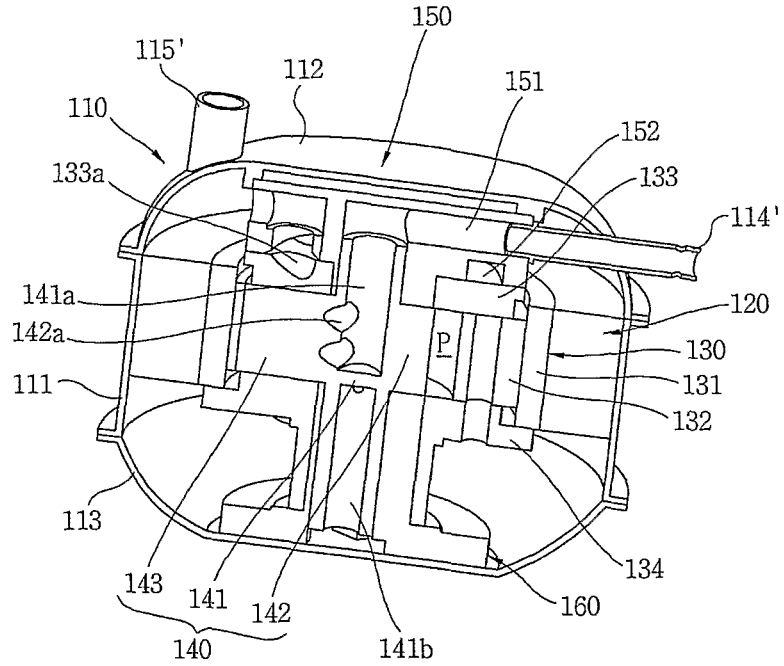
FIG. 2 is a transverse cross-sectional view showing a compressor in accordance with a second embodiment of the present invention.
Figure 3:
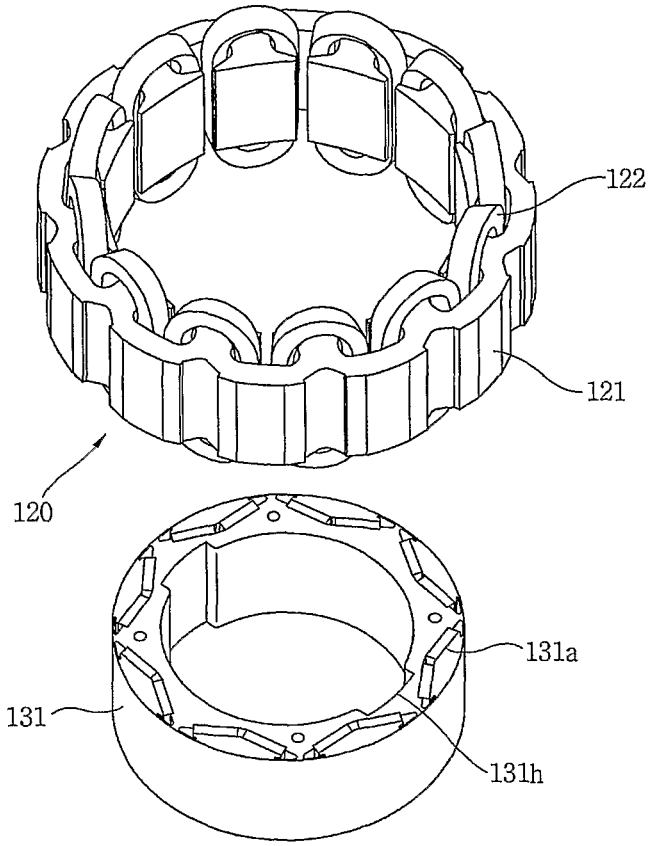
FIG. 3 is an exploded perspective view showing one example of an electric motor of a compressor in accordance with one embodiment of the present invention.
Figure 4:
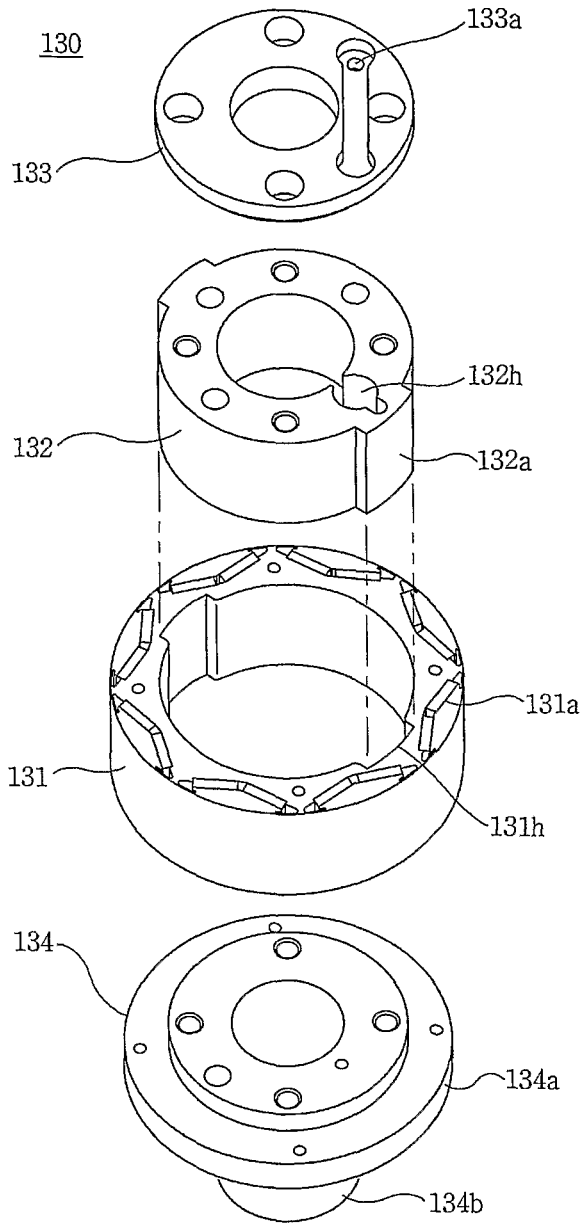
FIGS. 4 and 5 each illustrate an exploded perspective view showing one example of a compression mechanism part of a compressor in accordance with one embodiment of the present invention.
Figure 5:
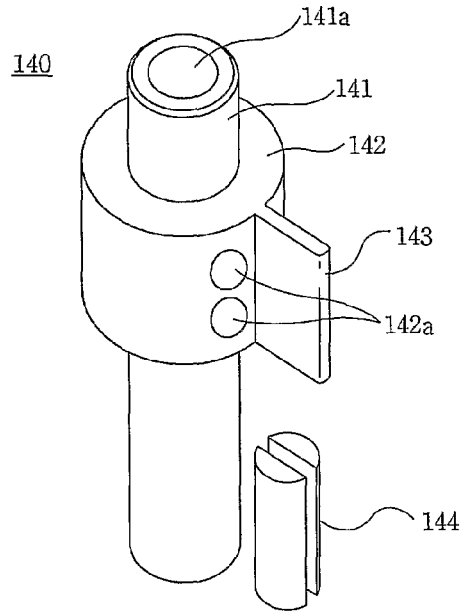

FIG. 1 is a transverse cross-sectional view showing a compressor in accordance with a first embodiment of the present invention, FIG. 2 is a transverse cross-sectional view showing a compressor in accordance with a second embodiment of the present invention, FIG. 3 is an exploded perspective view showing one example of an electric motor of the compressor in accordance with one embodiment of the present invention, and FIGS. 4 and 5 each illustrate an exploded perspective view showing one example of a compression mechanism part of the compressor in accordance with one embodiment of the present invention.

As shown in FIG. 1, a compressor in accordance with first and second embodiments of the present invention includes a hermetic container 110, a stator 120 installed within the hermetic container 110, a first rotating member 130 installed within the stator 120 and rotating by a rotating electromagnetic field from the stator 120, a second rotating member 140 rotating within the first rotating member 130 by a rotational force transferred from the first rotating member 130 for compressing refrigerant therebetween, and first and second bearings 150 and 160 supporting the first and second rotating members 130 and 140 to be able to rotate within the hermetic container 110. An electromotive mechanism part which provides power through an electrical reaction employs, for example, a BLDC motor including the stator 120 and the first rotating member 130, and a compression mechanism part which compresses refrigerant through a mechanical reaction includes the first and second rotating members 130 and 140, and the first and second bearings 150 and 160. Therefore, by installing the electromotive mechanism part and the compression mechanism part in a radial direction, the total height of the compressor can be reduced. Although the embodiments of the present invention describe a so-called inner rotor type having the compression mechanism part on the inside of the electromotive mechanism part as an example, any person of ordinary skill in the art would easily find out that the general ideal described above can also be applied conveniently to a so-called outer rotor type having the compression mechanism part on the outside of the electromotive mechanism part.

The hermetic container 110, as shown in FIG. 1, is composed of a cylinder-shaped body 111, and upper/lower shells 112 and 113 coupled to the top/bottom of the body 111 and stores oil at a suitable height to lubricate or smooth the first and second rotating members 130 and 140 (see FIG. 1). The upper shell 112 includes a suction tube 114 at a predetermined position for sucking refrigerant and a discharge tube 115 at another predetermined position for discharging refrigerant. Here, whether a compressor is a high-pressure type compressor or a low-pressure type compressor is determined depending on whether the interior of the hermetic container 110 is filled with compressed refrigerants or pre-compressed refrigerants, and the position of the suction tube 114 and discharge tube 115 should be determined based on that.

Referring to FIG. 1, the first embodiment of the present invention introduces a low pressure compressor. To this end, the suction tube 114 is connected to the hermetic container 110 and the discharge tube 115 is connected to the compression mechanism part. Thus, when a low-pressure refrigerant is sucked in through the suction tube 114, it fills the interior of the hermetic container 110 and flows into the compression mechanism part. In the compression mechanism part, the low-pressure refrigerant is compressed to high pressure and then exits outside directly through the discharge tube 115. On the other hand, the second embodiment of the present invention shown in FIG. 2 is a high pressure compressor, where the suction tube 114' is directly connected to the compression mechanism part through the hermetic container 110. The compressed refrigerant from the compression mechanism part is discharged into the interior of the hermetic container 110, so the interior of the container 110 is filled with the high pressure refrigerant. The high pressure refrigerant inside the hermetic container 110 is discharged outside through a discharge tube 115', one end of which passes through the hermetic container 110 to be disposed inside the container 110. The configuration for the high pressure compressor, compared with the configuration for the low pressure compressor, may experience some compression loss because the high pressure refrigerant is first discharged into the hermetic container 110 and then exits outside through the discharge tube 115', but pulsation of the refrigerant can be reduced and generates less noise than the low pressure compressor. Meanwhile, it is also possible to construct a compressor without the hermetic container 110 and having the suction tube 114, 114' and the discharge tube 115, 115' are all inserted into the compression mechanism part to let refrigerant directly be sucked into or discharged from the compression mechanism part. In this case, however, it is desirable to install an accumulator at the same time of the installation of the compressor so as to separate liquid refrigerant and provide the refrigerant to the compression mechanism part in a stable manner.

The stator 120, as shown in FIG. 3, is composed of a core 121, and a coil 122 primarily wound around the core 121. While a core used for a conventional BLDC motor has 9 slots along the circumference, the core 121 of a BLDC motor has 12 slots along the circumference because the stator in a preferred embodiment of the present invention has a relatively a large diameter. Considering that a coil winding number increases with an increasing number of core slots, in order to generate an electromagnetic force of the conventional stator 120, the core 121 may have a smaller height.

The first rotating member 130, as shown in FIG. 4, is composed of a rotor 131, a cylinder 132, a first cover 133 and a second cover 134. The rotor 131 has a cylindrical shape, with the rotor 131 rotating within the stator 120 (see FIG. 1) by a rotating electromagnetic field generated from the stator 120 (see FIG. 1), and inserted therethrough are plural permanent magnets 131*a* in an axial direction to generate a rotating magnetic field. Similar to the rotor 131, the cylinder 132 also takes the form of a cylinder to create a compression chamber P (see FIG. 1) inside. The rotor 131 and the cylinder 132 can be manufactured separately and joined together later. In one example, a pair of mount protrusions 132*a* is arranged at the outer circumferential surface of the cylinder 132, and grooves 131*h* having a corresponding shape to the mount protrusions 132*a* of the cylinder 132 are formed in the inner circumferential surface of the rotor 131 such that the outer circumferential surface of the cylinder 132 is engaged with the inner circumferential surface of the rotor 131. More preferably, the rotor 131 is integrally formed with the cylinder 132, with the permanent magnets 131*a* mounted in holes that are additionally formed in the axial direction.

The first cover 133 and the second cover 134 are coupled to the rotor 131 and/or the cylinder 132 in the axial direction, and the compression chamber P (see FIG. 1) is defined between the cylinder 132 and the first and second covers 133 and 134. The first cover 133 has a planar shape and is provided with a discharge port 133*a* through which a compressed refrigerant from the compression chamber P (see FIG. 1) exits and a discharge valve (not shown) mounted thereon. The second cover 134 is composed of a planar shape cover 134*a*, and a downwardly projecting hollow shaft 134*b* at the center. The shaft 134*b* is not absolutely required, but its role in receiving a load acting thereon increases a contact area with the second bearing 160 (see FIG. 1) and more stably supports the rotation of the second cover 134. Since the first and second covers 133 and 134 are bolt-fastened to the rotor 131 or the cylinder 132 in the axial direction, the rotor 131, the cylinder 132, and the first and second covers 133 and 134 rotate together as one unit.

Figure 6:
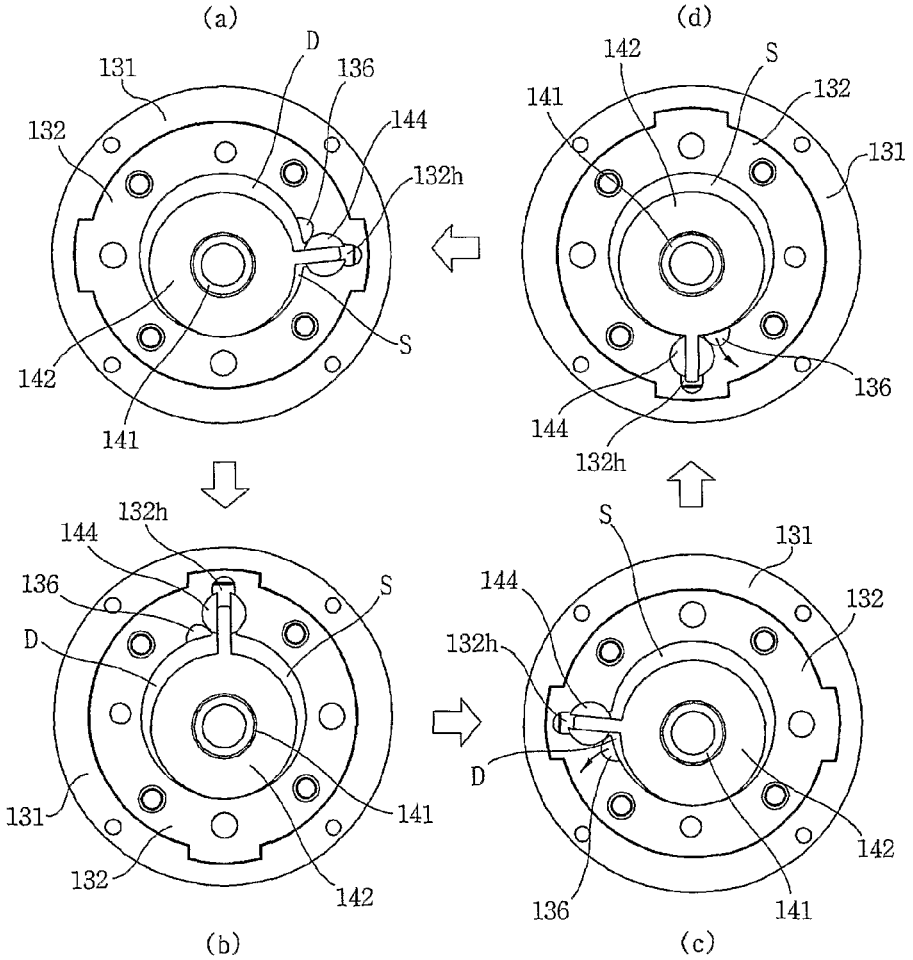
FIG. 6 is a plan view showing one example of a vane mount structure adopted to a compressor in accordance with one embodiment of the present invention.

The second rotating member 140, as shown in FIG. 5, is composed of an axis of rotation 141, a roller 142, and a vane 143. The axis of rotation 141 is extended in the roller axis direction from both surfaces of the roller 142, with the axis being projected further from the bottom surface of the roller 142 than from the top surface of the roller 142 to provide stable support under any load. Preferably, the axis of rotation 141 is integrally formed with the roller 142, but even if they have been manufactured separately, they must join together to be able to rotate as one unit. As the axis of rotation 141 takes the form of a hollow shaft with a blocked center portion, it is better to arrange a suction passage 141*a* through which refrigerant is sucked in and a passage of an oil feeder 141*b* (see FIG. 1) separately from each other so as to minimize the mixing of oil and refrigerant. The oil feeder 141*b* (see FIG. 1) of the axis of rotation 141 is provided with a helical member to assist oil ascending by a rotational force, or a groove to assist oil ascending by a capillary action. The axis of rotation 141 and the roller 142 each have all kinds of oil feed holes (not shown) and oil storage grooves (not shown) for supplying oil from the oil feeder 141*b* (see FIG. 1) into between two or more members subject to sliding interactions. The roller 142 has suction passages 142*a* radially penetrating it for the communication of the suction passage 141*a* of the axis of rotation 141 with the compression chamber P (see FIG. 1), such that refrigerant is sucked into the compression chamber P (see FIG. 1) through the suction passage 141*a* of the axis of rotation 141 and the suction passage 142*a* of the roller 142. The vane 143 is formed on the outer circumference surface of the roller 142, with the vane 143 being disposed to extend radially and rotate at a preset angle while making a linear reciprocating motion, along bushes 144, within a vane mount slot 132*h* (see FIG. 6) of the first rotating member 130 (see FIG. 1). As shown in FIG. 6, a couple of bushes 144 limits the circumferential rotation of the vane 143 to below a preset angle and guides the vane 143 to make the linear reciprocating motion through a space defined between the couple of bushes 144 that are mounted within the vane mount slot 132*h* (see FIG. 6). Even though oil may be supplied to enable the vane 143 to attain successful lubrication while reciprocating linearly within the bushes 144, it is also possible to make the bushes 144 of natural-lubricating materials. For example, the bushes 144 can be manufactured in use of a suitable material sold under the trademark of Vespel SP-21. Vespel SP-21 is a polymer material which combines excellent wear resistance, heat resistance, natural lubricity, flame resistance, and electrical insulation.

FIG. 6 is a plan view showing a vane mount structure and a running cycle of the compression mechanism part in a compressor according to the present invention.

To explain the mount structure of the vane 143 with reference to FIG. 6, a vane mount slot 132*h* is formed axially and longitudinally in the inner peripheral surface of the cylinder 132, and a couple of bushes 144 fit into the vane mount slot 132*h*, and the vane 143 integrally formed with the axis of rotation 141 and the roller 142 is inserted between the bushes 144. The cylinder 132 and the roller 142 define the compression chamber P (see FIG. 1) between them, with the compression chamber P (see FIG. 1) being divided by the vane 143 into a suction region S and a discharge region D. As noted earlier, the suction passages 142*a* (see FIG. 1) of the roller 142 are positioned in the suction region S, and the discharge port 133*a* (see FIG. 1) of the first cover 133 (see FIG. 1) is positioned in the discharge region D, with the suction passages 142*a* (see FIG. 1) of the roller 142 and the discharge port 133*a* (see FIG. 1) of the first cover 133 (see FIG. 1) being disposed to communicate with a discharge incline portion 136 contiguous with the vane 143. Therefore, the vane 143 which is integrally manufactured with the roller 142 in the present invention compressor and assembled to slidably movable between the bushes 144 can reduce frictional loss caused by the sliding contact and lower a refrigerant leak between the suction region S and the discharge region D more than a spring-supported vane which is manufactured separately from the roller or the cylinder in a conventional rotary compressor.

At this time, the rotation of the cylinder shape rotors 131 and 132 is transferred to the vane 143 formed at the second rotating member 143 so as to rotate the rotating member, and the bushes 144 inserted into the vane mount slot 132*h* oscillate, thereby enabling the cylinder shape rotors 131 and 132 and the second rotating member 140 to rotate together. While the cylinder 132 and the roller 142 rotate, the vane 143 makes a relatively linear reciprocating motion with respect to the vane mount slot 132*h* of the cylinder 132.

Therefore, when the rotor 131 receives a rotational force derived from the rotating electromagnetic field of the stator 120 (see FIG. 1), the rotor 131 and the cylinder 132 rotate. With the vane 143 being inserted into the cylinder 132, the rotational force of the rotor 131 and the cylinder 132 is transferred to the roller 142. Along the rotation of both, the vane 143 then linearly reciprocates between the bushes 144. That is, the rotor 131 and the cylinder 132 each have an inner surface corresponding to the outer surface of the roller 142, and these corresponding portions are repeatedly brought into contact with and separate from each other per rotation of the rotor 131/cylinder 132 and the roller 142. In so doing, the suction region S gradually expands and refrigerant or a working fluid is sucked into it, while the discharge region D gradually shrinks at the same time to compress the refrigerant or working fluid therein and discharge it later.

To see how the suction, compression and discharge cycle of the compression mechanism part works, FIG. 6*a* shows a step of sucking refrigerant or a working fluid into the suction region S. For instance, a working fluid is being sucked in and immediately compressed in the discharge D. When the first and second rotating members 130 and 140 are arranged as shown in FIG. 6*b*, the working fluid is continuously sucked into the suction region S and compression proceeds accordingly. When the first and second rotating members 130 and 140 are arranged as shown in FIG. 6*c*, the working fluid is continuously sucked in, and the refrigerant or the working fluid of a preset pressure or higher in the discharge region D is discharged through the discharge incline portion (or discharge port) 136. Lastly, when the first and second rotating members 130 and 140 are arranged as shown in FIG. 6*d*, the compression and discharge of the working fluid are finished. In this way, one cycle of the compression mechanism part is completed.

Figure 7:
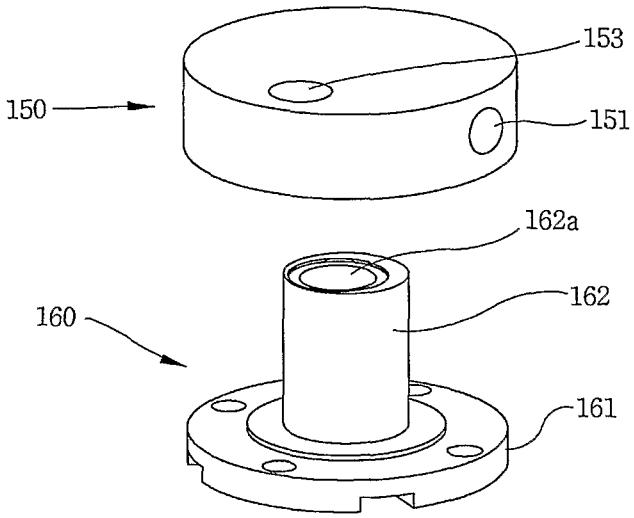
FIG. 7 is an exploded perspective view showing one example of a support member in the compressor in accordance with the first embodiment of the present invention.

FIG. 7 is an exploded perspective view showing an example of a support member of the compressor in accordance with the present invention.

Figure 8:
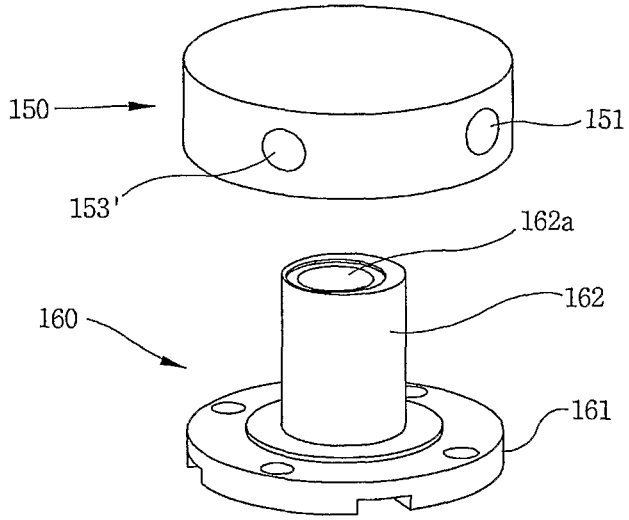
FIG. 8 is an exploded perspective view showing one example of a support member in the compressor in accordance with the second embodiment of the present invention.

As shown in FIGS. 1 and 6, the first and second rotating members 130 and 140 described earlier are rotatably supported on the inside of the hermetic container 110 by the first and second bearings 150 and 160 that are coupled in the axial direction. The first bearing 150 can be secured with a fixing rib or a fixing protrusion projected from the upper shell 112, and the second bearing 160 can be bolt-fastened to the lower shell 113. The first bearing 150 is constructed to adopt a journal bearing for rotatably supporting the outer peripheral surface of the axis of rotation 141 and the inner peripheral surface of the first cover 133, and a trust bearing for rotatably supporting the upper surface of the first cover 133. The first bearing 150 includes a suction guide passage 151 communicated with a suction passage 141*a* of the axis of rotation 141. When a compressor adopts a low-pressure system as shown in FIG. 1, the suction guide passage 151 is opened in communication with the interior of the hermetic container 110 to let the refrigerant having been sucked in through the suction tube 114 enter the hermetic container 110; when a compressor adopts a high-pressure system as shown in FIG. 2, part of the suction tube 114' is inserted into the suction guide passage 151. Moreover, the first bearing 150 includes a discharge guide passage 152 which is opened in communication with the discharge port 133*a* of the first cover 133, with the discharge port 133*a* taking the form of a ring or an annular ring to accommodate a revolving orbit of the discharge port 133*a* of the first cover 133 so as to discharge the refrigerant coming out through the discharge port 133*a* of the first cover 133 via the discharge tube 115 even if the discharge port 133*a* of the first cover 133 is revolving. In case of the low-pressure compressor as shown in FIG. 7, the discharge guide passage 152 includes a discharge tube mount hole 153 through which it can be connected directly to the discharge tube 115 for a direct discharge of the refrigerant outside; in case of the high-pressure compressor as shown in FIG. 8, the discharge guide passage 152 includes the discharge port 153' of the first bearing 150 to discharge the refrigerant into the hermetic container 110. The high-pressure refrigerant discharged through the discharge port 153' exists outside the hermetic container 110 via the discharge tube 115' as noted earlier.

The second bearing 160 is constructed to adopt a journal bearing for rotatably supporting the outer peripheral surface of the axis of rotation 141 and the inner peripheral surface of the second cover 134, and a trust bearing for rotatably supporting the lower surface of the roller 142 and the lower surface of the second cover 134. The second bearing 160 is composed of a planar shape support 161 that is bolt-fastened to the lower shell 113, and a shaft 162 disposed at the center of the support 161, with the shaft having an upwardly protruded hollow 162*a*. At this time, the center of the hollow 162*a* of the second bearing 160 is formed at a position eccentric from the center of the shaft 162 of the second bearing 160, with the center of the shaft 162 of the second bearing 160 being collinear with the rotation centerline of the first rotating member 130, while the center of the hollow 162*a* of the second bearing 160 being collinear with the axis of rotation 141 of the second rotating member 140. That is to say, although the center line of the axis of rotation 141 of the second rotating member 140 can be formed eccentric with respect to the rotation center line of the first rotating member 130, it can also be formed concentrically along the longitudinal center line of the roller 142. More details are now provided below.

Figure 9:
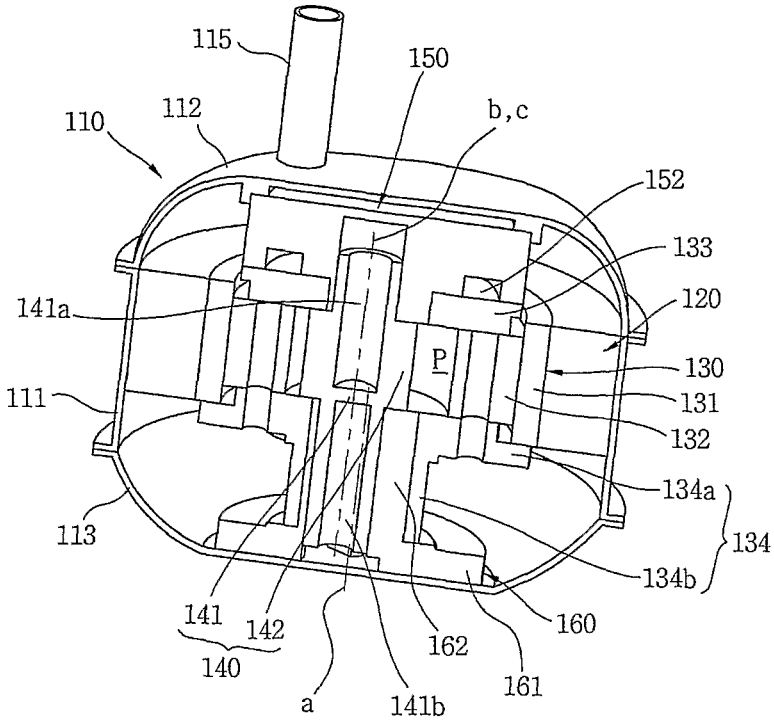
FIGS. 9 through 11 each illustrate a transverse cross-sectional view showing a rotation centerline of a compressor in accordance with one embodiment of the present invention.
Figure 10:
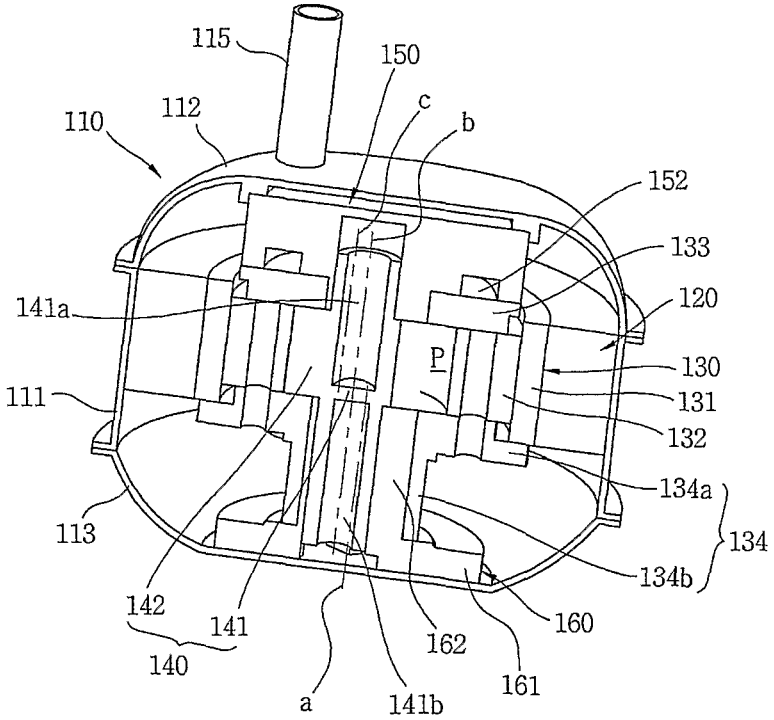
Figure 11:
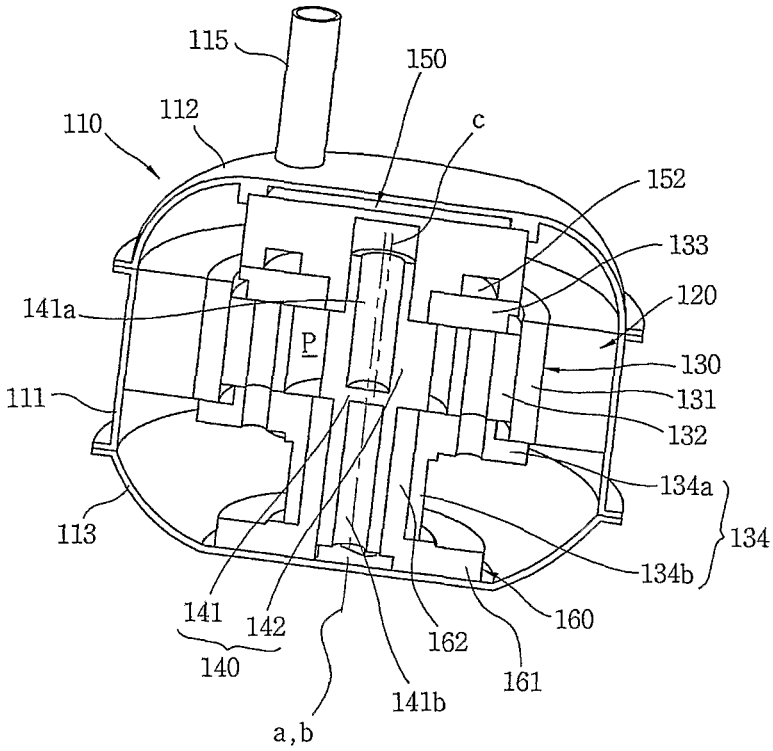

FIGS. 9 through 11 each illustrate a transverse cross-sectional view showing a rotation centerline of the compressor in accordance with the embodiment of the present invention.

To enable the first and second rotating members 130 and 140 to compress refrigerant while rotating, the second rotating member 140 is positioned eccentric with respect to the first rotating member 130. One example of relative positioning of the first and second rotating members 130 and 140 is illustrated in FIGS. 9 through 11. In the drawings, 'a' indicates a centerline of the first axis of rotation of the first rotating member 130, or a longitudinal centerline of the shaft 134*b* of the second cover 134, or a longitudinal centerline of the shaft 162 of the bearing 160. Here, because the first rotating member 130 includes the rotor 131, the cylinder 132, the first cover 133 and the second cover 134 as shown in FIG. 4, with all the elements rotating together en bloc, 'a' may be regarded as the rotation centerline of them, 'b' indicates a centerline of the second axis of rotation of the second rotating member 140 or a longitudinal centerline of the axis of the rotation 142, and 'c' indicates a longitudinal centerline of the second rotating member 140 or a longitudinal centerline of the roller 142.

As for the embodiment of the present invention illustrated in FIGS. 1 through 6, FIG. 9 shows that the centerline 'b' of the second axis of rotation is spaced apart a predetermined distance from the centerline 'a' of the first axis of rotation, and the longitudinal centerline 'c' of the second rotating member 140 is collinear with the centerline 'b' of the second axis of rotation. In this way, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P.

FIG. 10 shows that the centerline 'b' of the second axis of rotation is spaced apart a predetermined distance from the centerline 'a' of the first axis of rotation, and the longitudinal centerline 'c' of the second rotating member 140 is spaced apart a predetermined distance from the centerline 'b' of the second axis of rotation, but the centerline 'a' of the first axis of rotation and the longitudinal centerline 'c' of the second rotating member 140 are not collinear. Similarly, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P. As such, a larger eccentric amount than that in FIG. 9 can be given.

FIG. 11 shows that the centerline 'b' of the second axis of rotation is collinear with the centerline 'a' of the first axis of rotation, and the longitudinal centerline 'c' of the second rotating member 140 is spaced apart a predetermined distance from the centerline 'a' of the first axis of rotation and from the centerline 'b' of the second axis of rotation. Similarly, the second rotating member 140 is disposed eccentric with respect to the first rotating member 130, and when the first and second rotating members 130 and 140 rotate together by the medium of the vane 143, they repeatedly contact, separate, and retouch per rotation as explained before, thereby varying the volume of the suction region S/the discharge region D so as to compress refrigerant within the compression chamber P.

Figure 12:
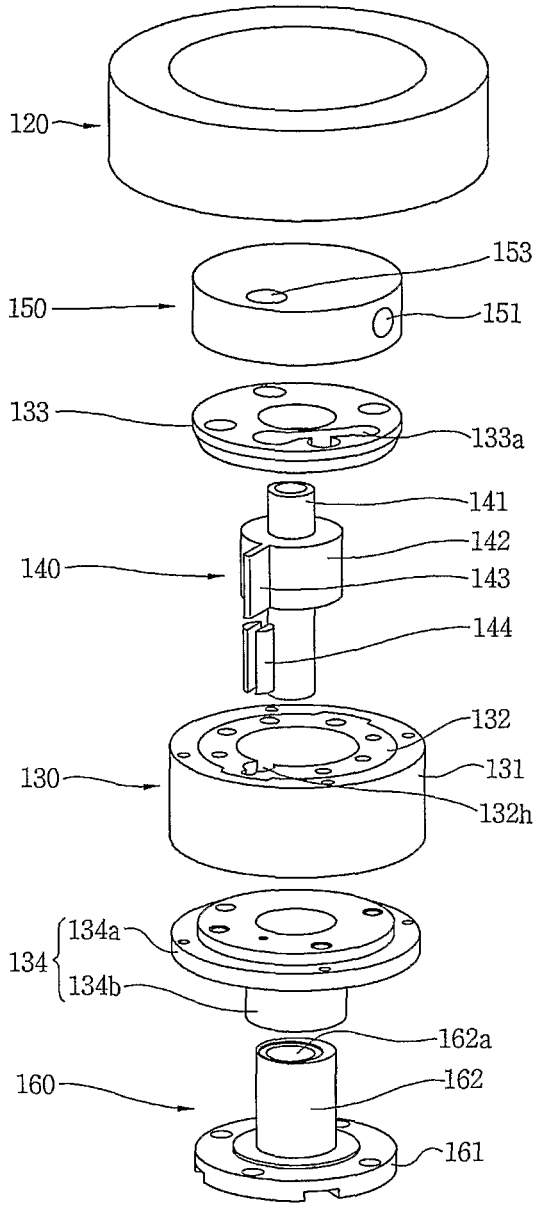
FIG. 12 is an exploded perspective view showing a compressor in accordance with one embodiment of the present invention.

FIG. 12 is an exploded perspective view showing a compressor in accordance with the first/second embodiment of the present invention.

To see an example of how the compressor according to the first/second embodiment of the present invention is assembled by referring to FIGS. 1 and 12, the rotor 131 and the cylinder 132 are either manufactured separately and then coupled, or manufactured in one unit from the beginning. The axis of rotation 141, the roller 142 and the vane 143 can also be manufactured separately or integrally, but either way, they should be able to rotate as one unit. The vane 143 is inserted between the bushes 144 within the cylinder 131. Overall, the axis of rotation 141, the roller 142 and the vane 143 are mounted within the rotor 131 and the cylinder 132. The first and second covers 133 and 134 are bolt-fastened in the axial direction of the rotor 131 and the cylinder 132, with the covers covering the roller 142 even if the axis of rotation 141 may pass therethrough.

After a rotation assembly assembled with the first and second rotating members 130 and 140 are put together as described above, the second bearing 160 is bolt-fastened to the lower shell 113, and the rotation assembly is then assembled to the second bearing 160, with the inner circumferential surface of the shaft 134*b* of the second cover 134 circumscribing the outer circumferential surface of the shaft 162, with the outer circumferential surface of the axis of rotation 141 being inscribed in the hollow 162*a* of the second bearing 160. Next, the stator 120 is press fitted into the body 111, and the body 111 is joined to the upper shell 112, with the stator 120 being positioned to maintain an air-gap with the outer circumferential surface of the rotation assembly. After that, the first bearing 150 is joined or assembled to the upper shell 112 in a way that the discharge tube 115 of the upper shell 112 is press fitted into the discharge mount hole 153 (see FIG. 6) of the first bearing. As such, the upper shell 122 assembled with the first bearing 150 is joined to the body 111, and the first bearing 150 which is fitted between the axis of rotation 141 and the first cover 133 is covered above by the shell 112 at the same time. Needless to say, the suction guide passage 151 of the first bearing 150 is in communication with the suction passage 141*a* of the axis of rotation 141, and the discharge guide passage 152 of the first bearing 150 is in communication with the discharge port 133*a* of the first cover 133.

Therefore, with all of the rotation assembly assembled with the first and second rotating members 130 and 140, the body 111 mounted with the stator 120, the upper shell 112 mounted with the first bearing 150, and the lower shell 113 mounted with the second bearing 160 being joined in the axial direction, the first and second bearings 150 and 160 rotatably support the rotation assembly onto the hermetic container 110 in the axial direction.

Figure 13:
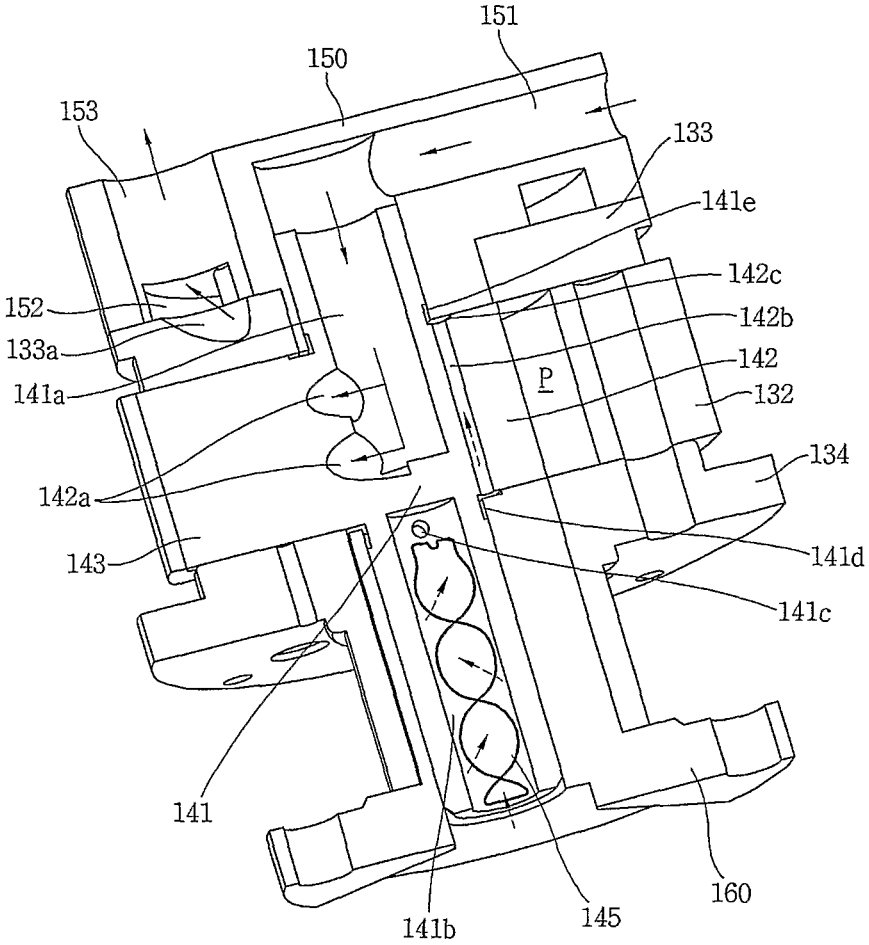
FIG. 13 is a transverse cross-sectional view showing how refrigerant and oil flow in a compressor in accordance with one embodiment of the present invention.

FIG. 13 is a transverse cross-sectional view showing how refrigerant and oil flow in a compressor in accordance with the first/second embodiment of the present invention.

To see how the first/second embodiment of the compressor of the present invention operates by referring to FIGS. 1 and 13, when electric current is fed to the stator 120, a rotating electromagnetic field is generated between the stator 120 and the rotor 131, and with the application of a rotational force from the rotor 131, the first rotating member 130, i.e., the rotor 131 and the cylinder 132, and the first and second covers 133 and 134 rotate together as one unit. As the vane is 134 is installed at the cylinder 131 to be able to linearly reciprocate, a rotational force of the first rotating member 130 is transferred to the second rotating member 140 so the second rotating member 140, i.e., the axis of rotation 141, the roller 142 and the vane 143, rotate together as one unit. As shown in FIGS. 9 through 11, because the first and second rotating members 130 and 140 are disposed eccentric with respect to each other, they repeatedly contact, separate, and retouch per rotation, thereby varying the volume of the suction region S/the discharge region D so as to compress refrigerant within the compression chamber P and to pump oil at the same time to lubricate between two slidingly contacting members.

When the first and second rotating members 130 and 140 rotate, refrigerant is sucked in, compressed and discharged. In more detail, the compression chamber P defined between the roller 142 and the cylinder 132 is divided into the suction region and the discharge region by the contact portion between the roller 142 and the cylinder 132 and by the vane 143. The contact portion between the roller 142 and the cylinder 132 continuously changes as the first and second rotating members 130 and 140 rotate, and it is touched once in each rotation. In accordance with a change in the contact portion between the roller 142 and the cylinder 132, the volume of the suction region and the volume of the discharge region change to suck in, compress and discharge refrigerant. When the discharge valve (not shown) is open at a pressure above a preset level, refrigerant starts to be discharged from the discharge region and the discharge continues until the contact portion between the roller 142 and the cylinder 132 overlaps with the discharge port 136 of the cylinder. Meanwhile, sometimes the position of the contact portion between the roller 142 and the cylinder 132 overlaps with the position of the vane 143, and this makes the division in the suction region and the discharge region disappear and creates one region in the entire compression chamber P instead. But the very next moment the position of the contact portion between the roller 142 and the cylinder 132 and the position of the vane 143 change on account of the rotation of the first and second rotating members 130 and 140, and the compression chamber P is again divided into a volume-expanding suction region S and a volume-shrinking discharge region D. A refrigerant having been sucked in through the suction region in a previous rotation is compressed in the discharge region in a subsequent rotation. The time when the refrigerant location changes from the suction region to the discharge region presumably coincides with the time when the position of the contact portion between the roller 142 and the cylinder 132 overlaps with the position of the vane 143.

That is to say, on account of a suction pressure (negative pressure) generated within the suction region with a gradual increase in the volume of the suction region, refrigerant is sucked into the suction region of the compression chamber P through the suction guide passage 151 of the first bearing 150, the suction passage 141*a* of the axis of rotation 141 and the suction passage 142*a* of the roller 142. Also, with a gradual decrease in the volume of the discharge region, the refrigerant is compressed therein, and when the discharge valve (not shown) is open at a pressure above the preset level the compressed refrigerant is then discharged outside of the hermetic container 110 through the discharge port 136 of the cylinder 132, the discharge port 133*a* of the first cover, and the discharge guide passage 152 of the first bearing 150. Depending on the configuration of the passage for a low-pressure refrigerant being sucked into the suction guide passage 151 of the first bearing 150 and the configuration of the passage for a high-pressure refrigerant being discharged from the discharge guide passage 152 of the first bearing 150, compressors can be categorized into high pressure compressors or low pressure compressors. If a compressor is built based on a low pressure system as shown in FIG. 1, a low-pressure refrigerant is sucked into the hermetic chamber 110 through the suction tube 114, with the interior of the hermetic chamber 110 being communicated with the suction guide passage 151, and a high-pressure compressed refrigerant is discharged directly through the discharge tube 115 that is inserted into the discharge guide passage 152. On the other hand, if a compressor is built based on a high pressure system as shown in FIG. 2, a low-pressure refrigerant is sucked in directly through the suction tube 114' that is inserted into the suction guide passage 151, and a high-pressure compressed refrigerant is discharged into the hermetic chamber 110 through the discharge port 153' (see FIG. 8) that is at one end of the discharge guide passage 152 and then eventually outside of the hermetic chamber 110 through the discharge tube 115'. In summary, with the low pressure system, refrigerant is sucked into the compression chamber P through the suction tube 114, the interior of the hermetic container 110, the suction guide passage 151 of the first bearing 150, the suction passage 141*a* of the axis of rotation 141 and the suction passage 142*a* of the roller 142, goes to the discharge region after one rotation, is compressed with a decrease in the volume of the compression region, and is discharged, if the discharge valve (not shown) is at a pressure above the preset level, outside of the hermetic container 110 through the discharge port 136 of the cylinder 132, the discharge port 133*a* of the first cover 133, the discharge guide passage 152 of the first bearing 150, and the discharge tube 115. Meanwhile, with the high pressure system, refrigerant is sucked into the compression chamber P through the suction tube 114' the suction guide passage 151 of the first bearing 150, the suction passage 141*a* of the axis of rotation 141 and the suction passage 142*a* of the roller 142, goes to the discharge region after one rotation, is compressed with a decrease in the volume of the compression region, and is discharged, if the discharge valve (not shown) is at a pressure above the preset level, outside of the hermetic container 110 through the discharge port 136 of the cylinder 132, the discharge port 133*a* of the first cover 133, the discharge guide passage 152 of the first bearing 150, and the discharge tube 115'.

The change in volume of the suction and discharge regions is due to differences in relative positioning of the contact portion between the roller 142 and the cylinder 132 and of the position of the vane 143, so the suction passage 142*a* of the roller and the discharge port 136 of the cylinder 132 must be disposed opposite from each other with respect to the vane 143. In addition, suppose that the first and second rotating members 130 and 140 rotate in a counterclockwise direction. Then the contact portion between the roller 142 and the cylinder 132 will shift in a clockwise direction with respect to the vane 143. Thus, the discharge port 136 of the cylinder 132 should be positioned on more front side than the vane 143 in the rotation direction, and the suction passage 142*a* of the roller 142 should be positioned on more rear side than the vane 143. Meanwhile, the suction passage 142*a* of the roller 142 and the discharge port 136 of the cylinder 132 should be formed as close as possible to the vane 143 so as to reduce dead volume of the compression chamber P which does not expand or shrink for actual compression of the refrigerant.

Moreover, during the rotation of the first and second rotating members 130 and 140, oil is supplied to sliding contact portions between the bearings 150 and 160 and the first and second rotating members 130 and 140, or to sliding contact portions between the first rotating member 130 and the second rotating member 140, so as to lubricate between the members. To this end, the axis of rotation 141 is dipped into the oil that is stored at the lower area of the hermetic container 110, and any kind of oil feed passage for oil supply is provided to the second rotating member 140. In more detail, when the axis of rotation 141 starts rotating in the oil stored at the lower area of the hermetic container 110, the oil pumps up or ascends along the helical member 145 or groove disposed within an oil feeder 141*b* of the axis of the rotation 141 and escapes through an oil feed hole 141*c* of the axis of the rotation 141, not only to gather up at an oil storage groove 141*d* between the axis of rotation 141 and the second bearing 160 but also to lubricate between the axis of rotation 141, the roller 142, the second bearing 160, and the second cover 134. The oil having been gathered up at the oil storage groove 141*d* between the axis of rotation 141 and the second bearing 160 pumps up or ascends through the oil feed hole 142*b* of the roller 142, not only to gather up at oil storage grooves 141*e* and 142*c* between the axis of rotation 141, the roller 142 and the first bearing 150 but also to lubricate between the axis of rotation 141, the roller 142, the first bearing 150, and the first cover 133. Besides, the oil may also be fed between the vane 143 and the bush 144 through an oil groove or an oil hole, but it is better to manufacture the bush 144 out of natural lubricating materials instead.

As has been explained so far, because refrigerant is sucked into the suction passage 141*a* of the axis of rotation 141 and oil is pumped through the oil feeder 141*b* of the axis of rotation 141, the refrigerant circulating passage is isolated from the oil circulating passage on the axis of rotation 141 such that the refrigerant may not be mixed with the oil. Further, a much oil and refrigerant leak can be reduced to secure working reliability of the compressor overall.

The present invention has been described in detail with reference to the embodiments and the attached drawings. However, the scope of the present invention is not limited to the embodiments and the drawings, but defined by the appended claims.

The invention claimed is:

1. A compressor, comprising:

a hermetic container including a suction tube, through which a refrigerant is sucked inside of the hermetic container;

a stator secured within the hermetic container that generates a rotating electromagnetic field inside the stator;

a cylinder type rotor that is rotated within the stator by the rotating electromagnetic field of the stator, and defines a compression chamber inside;

a roller that rotates within the compression chamber of the cylinder type rotor by a rotational force transferred from the cylinder type rotor, and compresses the refrigerant during rotation;

a vane that divides the compression chamber into a suction region, into which the refrigerant is sucked, and a compression region, in which the refrigerant is compressed and discharged from, wherein the vane transfers the rotational force from the cylinder type rotor to the roller;

a rotational shaft that is integrally formed and rotated together with the roller, and that extends in an axial direction; and a suction passage, through which the refrigerant is sucked into the compression chamber through the rotational shaft and the roller, wherein the suction passage is separated from the suction tube by a region of open space within the hermetic container.

2. The compressor according to claim 1, wherein the suction passage comprises a first suction passage that is open in the axial direction of the rotational shaft, and a second suction passage that communicates with the first suction passage and the compression chamber.

3. The compressor according to claim 2, wherein the second suction passage extends in a radial direction between a center of the rotational shaft and an outer circumferential surface of the roller to be oriented toward the center of the rotational shaft.

4. The compressor according to claim 3, wherein the second suction passage is formed in the outer circumferential surface of the roller in communication with a portion of a suction region portion contiguous with the vane.

5. The compressor according to claim 3, wherein the second suction passage is positioned on a more rear side than the vane with respect to a rotation direction of the cylinder and the rotor.

6. The compressor according to claim 1, wherein the compressor further comprises:

a first cover and a second cover secured to an upper portion and a lower portion of the cylinder type rotor that rotate with the cylinder type rotor as one unit and define the compression chamber between the cylinder type rotor and the roller, and receive the rotational shaft therethrough; and a first bearing and a second bearing secured to an interior of the hermetic container that rotatably support the first cover and the second cover together with the rotational shaft, and wherein one of the first bearing or the second bearing includes a suction guide passage that communicates with the suction passage to guide the refrigerant.

7. The compressor according to claim 6, wherein the suction guide passage comprises a first suction guide passage that communicates with the inside of the hermetic container in a radial direction of one of the first bearing or the second bearing so as to open inside of the hermetic container, and a second suction guide passage that communicates in a shaft direction of one of the first bearing or the second bearing so as to communicate the first suction guide passage with the suction passage.

8. The compressor according to claim 6, wherein one of the first cover or the second cover comprises a discharge port that communicates with the compression region, and wherein one of the first bearing or the second bearing comprises a discharge guide passage that communicates with the discharge port of one of the first cover or the second cover to guide refrigerant discharge.

9. The compressor according to claim 8, wherein the discharge port of one of the first cover or the second cover is formed in communication with a portion of the compression region contiguous with the compression region.

10. The compressor according to claim 8, wherein the discharge guide passage of one of the first bearing or the second beating is formed in an annular or in a ring shape that circumscribes a revolving orbit of the discharge port of one of the first cover or the second cover.

11. The compressor according to claim 8, further comprising:

a discharge tube inserted into one of the first bearing or the second bearing from outside of the hermetic container, such that the discharge tube is connected with the discharge guide passage of one of the first bearing or the second bearing.

12. The compressor according to claim 1, wherein the vane is formed on an outer circumferential surface of the roller and extends radially therefrom.

13. The compressor according to claim 12, wherein a vane mount slot is formed axially and longitudinally in an inner peripheral surface of the cylinder type rotor, and wherein the vane is inserted into the vane mount slot.

14. A compressor, comprising:

a hermetic container including a suction tube and a discharge tube;

a stator secured within the hermetic container that generates a rotating electromagnetic field inside the stator;

a first rotating member that is rotated within the stator by the rotating electromagnetic field of the stator about a first rotational shaft, which is collinear with a center of the stator and extends in a longitudinal direction, and includes a first cover and a second cover secured to an upper portion and a lower portion thereof to rotate together as one unit;

a second rotating member that rotates within the first rotating member by a rotational force transferred from the first rotating member about a second rotational shaft, which extends through the first and second covers, and compresses a refrigerant in a compression chamber, which is defined between the first and second rotating members;

a vane that divides the compression chamber into a suction region, into which the refrigerant is sucked, and a compression region, in which the refrigerant is compressed and discharged from, wherein the vane transfers the rotational force from the first rotating member to the second rotating member;

a bearing secured within the hermetic container that rotatably supports the first rotational shaft, the second rotational shaft, and the first rotating member;

a suction passage, through which the refrigerant is sucked into the compression chamber through the second rotational shaft and the second rotating member; and a discharge port formed in one of the first cover or the second cover, wherein the discharge port communicates with the compression region, wherein the suction passage is separated from the suction tube by a region of open space within the hermetic container, and wherein the suction region is contiguous with the vane.

15. The compressor according to claim 14, wherein the suction passage comprises a first suction passage that is open in an axial direction of the second rotational shaft, and a second suction passage that communicates with the first suction passage and the compression chamber.

16. The compressor according to claim 15, wherein the second suction passage extends in a radial direction between a center of the second rotational shaft and an outer circumferential surface of the second rotating member to be oriented toward the center of the second rotational shaft.

17. The compressor according to claim 14, wherein the bearing includes a suction guide passage that communicates with the inside of the hermetic container and the suction passage to guide the refrigerant suction.

18. The compressor according to claim 17, wherein the suction guide passage comprises a first suction guide passage that communicates in a radial direction of the bearing, and a second suction guide passage that communicates in a shaft direction of the bearing to communicate the first suction guide passage with the suction passage.

19. The compressor according to claim 14, wherein the vane is formed on an outer circumferential surface of the second rotating member and extends radially therefrom.

20. The compressor according to claim 19, wherein a vane mount slot is formed axially and longitudinally in an inner peripheral surface of the first rotating member, and wherein the vane is inserted into the vane mount slot.

* * * * *